US010794410B1

(12) United States Patent
Yang

(10) Patent No.: US 10,794,410 B1
(45) Date of Patent: Oct. 6, 2020

(54) FOLDABLE AERODYNAMIC DRAG REDUCING PLATE ASSEMBLY FOR AN INTERMODAL CONTAINER

(71) Applicant: Charles C. Yang, Surprise, AZ (US)

(72) Inventor: Charles C. Yang, Surprise, AZ (US)

( * ) Notice: Subject to any disclaimer, the term of this patent is extended or adjusted under 35 U.S.C. 154(b) by 0 days.

(21) Appl. No.: 16/420,666

(22) Filed: May 23, 2019

(51) Int. Cl.
*F15D 1/10* (2006.01)
*B65D 88/12* (2006.01)
*F15D 1/00* (2006.01)
*B61D 49/00* (2006.01)

(52) U.S. Cl.
CPC ..... *F15D 1/10* (2013.01); *B61D 49/00* (2013.01); *B65D 88/121* (2013.01); *F15D 1/0025* (2013.01)

(58) Field of Classification Search
CPC ..... B61D 17/02
USPC ..... 296/180.4
See application file for complete search history.

(56) References Cited

U.S. PATENT DOCUMENTS 2,243,906 A * 6/1941 Huet ..... B61C 1/06 105/1.1
2,468,590 A * 4/1949 Dean ..... B61D 17/02 105/21
3,697,120 A * 10/1972 Saunders ..... B62D 35/001 296/180.4
3,854,769 A * 12/1974 Saunders ..... B62D 35/001 296/180.4
4,682,808 A * 7/1987 Bilanin ..... B62D 35/001 296/180.4
4,756,256 A * 7/1988 Rains ..... B61D 3/02 105/1.1
4,867,397 A * 9/1989 Pamadi ..... B62D 35/00 296/180.1
4,966,407 A 10/1990 Lusk
5,465,669 A 11/1995 Andrus
6,546,878 B1 4/2003 Smith et al.
6,669,270 B1 * 12/2003 Card ..... B62D 35/008 296/180.1

(Continued)

FOREIGN PATENT DOCUMENTS

CA 2827931 3/2014
DE 102016120817 B4 11/2015

(Continued)

OTHER PUBLICATIONS

Thesis: "Increasing Railway Efficiency and Capacity Through Improved Operations, Contro and Planning", by Yung-Cheng Lai B.S., National Taiwan University, 2002 M.S., University of Illinois at Urbana-Champaign, 2004. (See attached Lai_PhD.pdf).

(Continued)

*Primary Examiner* — Hilary L Gutman
(74) *Attorney, Agent, or Firm* — Mark V. Loen

(57) ABSTRACT

The embodied invention is a foldable aerodynamic drag reducing plate assembly that is installed on shipping container ends. The drag reducing plates are in two parts and designed to incorporate hinges and attaching components specifically for the spacing and position of corner lifting holes that are part of a standard container shipping car. The drag reducing plates include locking bars that provide stability when a train is moving at high speed. Also, connecting clips, stiffening channels, or hinges are used to combine two halves of the drag reducing plate design into a single, stiffened unit.

3 Claims, 13 Drawing Sheets

(56) References Cited

U.S. PATENT DOCUMENTS

| | | | | |
|---|---|---|---|---|
| 6,854,788 | B1 | 2/2005 | Graham | |
| 6,986,544 | B2 * | 1/2006 | Wood | B62D 35/001 296/180.1 |
| 7,073,845 | B2 * | 7/2006 | Ortega | B62D 35/001 296/180.2 |
| 7,784,409 | B2 | 8/2010 | Iden et al. | |
| 7,827,918 | B2 | 11/2010 | Iden et al. | |
| 8,215,239 | B2 | 7/2012 | Iden | |
| 8,511,236 | B2 | 8/2013 | Iden | |
| 8,517,452 | B2 * | 8/2013 | Kenevan | B62D 35/001 180/903 |
| 8,827,351 | B1 * | 9/2014 | Kenevan | B62D 35/001 180/903 |
| 2010/0258029 | A1 | 10/2010 | Iden et al. | |
| 2013/0106136 | A1 | 5/2013 | Smith et al. | |
| 2015/0102633 | A1 | 4/2015 | Dieckmann et al. | |
| 2016/0236726 | A1 | 8/2016 | Baker et al. | |
| 2017/0361880 | A1 | 12/2017 | Gardner | |
| 2018/0043943 | A1 | 2/2018 | Polidori et al. | |

FOREIGN PATENT DOCUMENTS

| | | | | |
|---|---|---|---|---|
| FR | 788753 A | * | 10/1935 | B61D 17/02 |
| GB | 2098558 A | * | 11/1982 | B62D 35/004 |
| GB | 2275234 A | * | 8/1994 | B62D 35/001 |
| WO | WO-2018202608 A1 | * | 11/2018 | B62D 35/001 |

OTHER PUBLICATIONS

Thesis: "Aerodynamic Drag on Intermodal Rail Cars", by Philip Donovan Kinghorn, Brigham Young University, Jun. 1, 2017, (See attached Kinghorn_PhD.pdf).

Thesis: "An investigation of train drag reduction using sub-boundary layer vortex generators on a simplifiedintermodal well car geometry" by Alexander M. Peters, Iowa State University, 2017 (See attached Peters_PhD.pdf).

Trailer Drag Reduction Report, Anna Sawabini et al. (See attached Sawabini_Report.pdf) most closely related*, Jun. 2001.

* cited by examiner

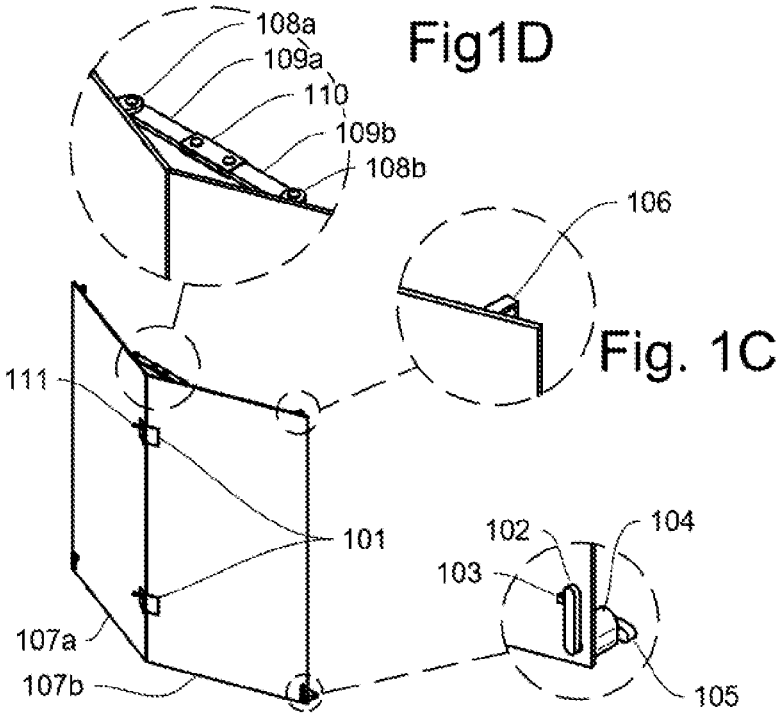
Fig1D
Fig. 1C
Fig. 1A
Fig. 1B
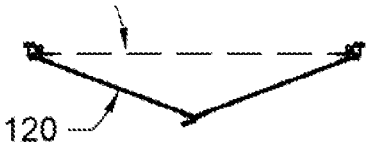
Fig. 1H
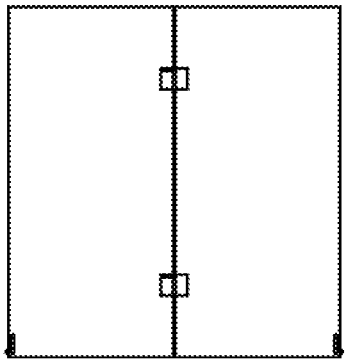
Fig. 1E
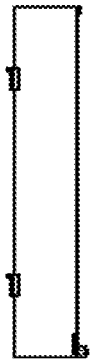
Fig. 1F
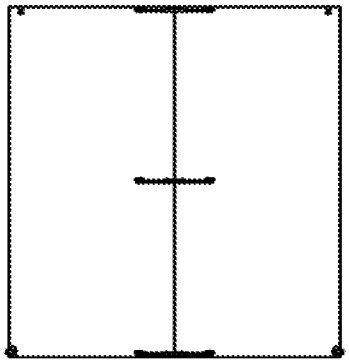
Fig. 1G Fig. 2E
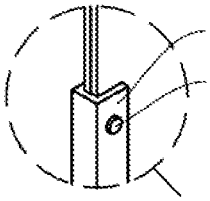
Fig. 2F
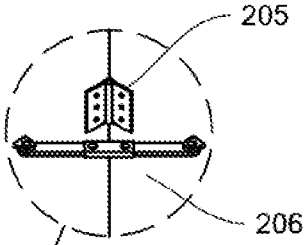
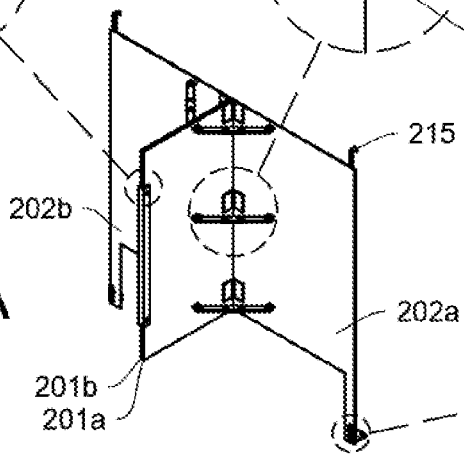
Fig. 2A
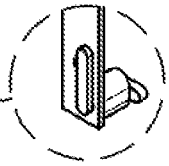
Fig. 2I
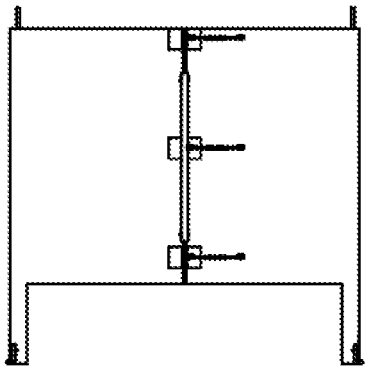
Fig. 2B
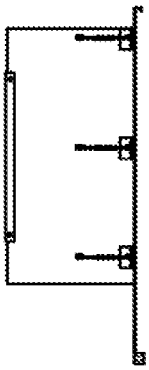
Fig. 2C
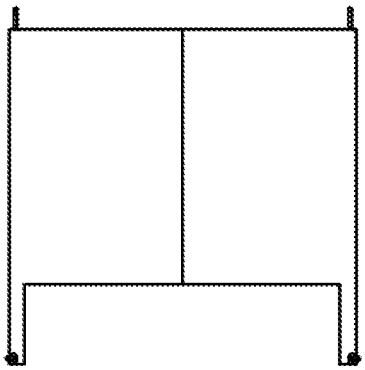
Fig. 2D Fig. 3F
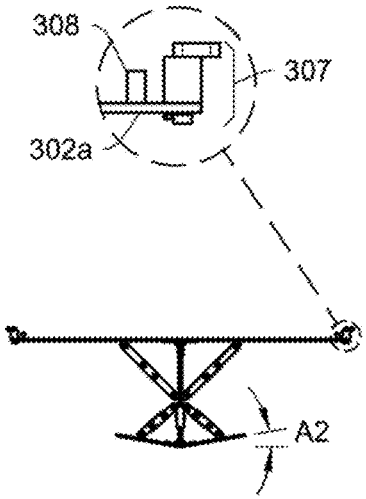
Fig. 3B
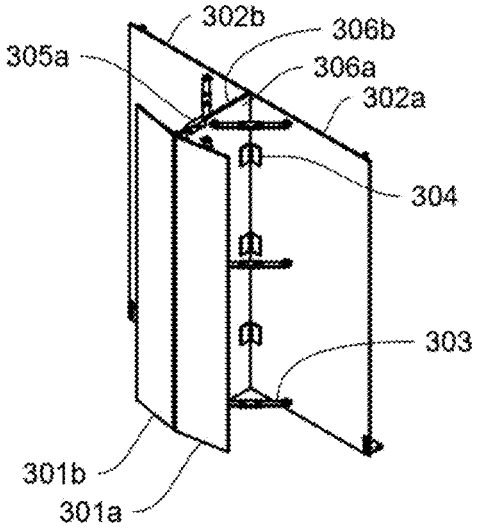
Fig. 3A
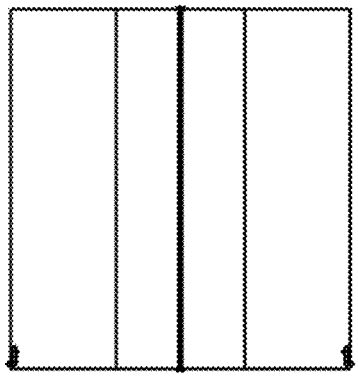
Fig. 3C
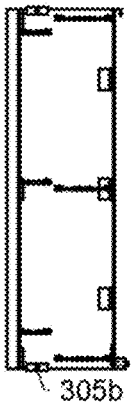
Fig. 3D
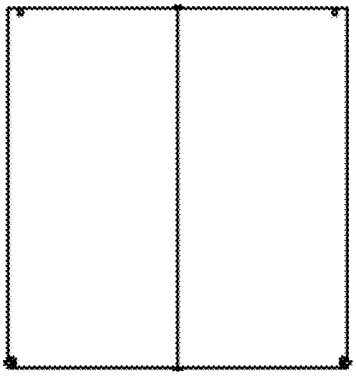
Fig. 3E

FOLDABLE AERODYNAMIC DRAG REDUCING PLATE ASSEMBLY FOR AN INTERMODAL CONTAINER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION

(1) Field of the Invention

This invention is directed to air drag reducing components that provide reduced aerodynamic drag on intermodal containers.

(2) Description of Related Art

US publication number 20100258029A1 describes air drag reducing devices (drag reducers) designed for a train container. However, the devices have not been widely implemented due to certain issues. The current drag reducers are over large for a single person to handle and maneuver into position for attachment. They also take up a lot of storage space when not in use.

U.S. Pat. No. 7,930,979 is another example of an over-complicated air stream design that requires a crane to lift as a practical matter.

As a practical matter, drag reducers have to be capable of being installed and removed when the container is positioned on a railroad flat car (or a well car), adding to the height off the ground and further complicating efforts to safely and securely attach them. The difficulties in handling require multiple individuals with ladders to install current art drag reducers.

When two containers are stacked, and the train is moving, each container must have a drag reducer for efficient air flow.

As another practical matter, a drag reducer cannot be permanently attached. Intermodal containers are used for ocean shipping and stacked in a highly compact manner, including the front ends. Permanent shrouds increase shipping costs as it requires containers to be separated further apart, resulting in a lower density shipping. Additionally, during shipping, the containers get the advantage of platooning, that is, the upstream car breaks the wind for the next car downwind.

Another difficulty is that the containers are installed on railroad container cars that require car to car couplers which make the containers separated by gaps of at least eleven feet. The gaps are too long to have the advantage of platooning.

Efficiency improvements by air drag reducers are approximately 6-25%, depending upon the design.

BRIEF SUMMARY OF THE INVENTION

The embodied invention is a foldable aerodynamic drag reducing plate assembly that is installed on shipping container ends. The drag reducing plates are in two parts and designed to incorporate hinges and attaching components specifically for the spacing and position of corner lifting holes that are part of a standard shipping container. The drag reducing plates include locking bars that provide stability when a train is moving at high speed. Also, connecting clips, stiffening channels, or hinges are used to combine two halves of the drag reducing plate design into a single, stiffened unit.

BRIEF DESCRIPTION OF THE SEVERAL VIEWS OF THE DRAWING(S)

FIGS. 1A-1H show a triangle front wind plate design.

FIGS. 2A-2G and 2I show a single fairing plate design in two connected parts.

FIGS. 3A-3F show a single front wind plate design in two connected parts.

DETAILED DESCRIPTION OF THE INVENTION

Figure 2G:
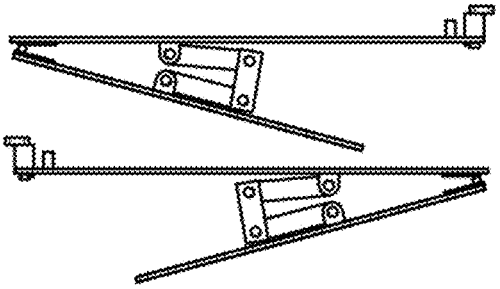

In FIG. 1A, a two plate air reducing drag design is shown in the shape of a triangle, with the two front wind plates 107*a,b* connected by a hinge 101 at their center edges. Optionally, the hinge pin includes a handle 111 that is designed for an operator to pull out so the two plates 107*a,b* can be separated for improved storage compactness. Preferably, the two front wind plates each make an angle (120, FIG. 1H) between 0 and 30 degrees from the front of the intermodal container.

In FIG. 1B, an insert assembly with a locking arrangement is shown. A handle 102 is held in place by a stop 103, and an insert 104 that will fit into a lower hole on an intermodal container. A rotating locking pin 105 is shown and prevents the insert 104 from slipping out of the container hole. The handle and the locking pin are connected by a rigid shaft (not shown) inside the insert 104. To unlock the insert assembly, an operator rotates the handle 90 degrees CCW (as seen in the view shown) by first sliding the handle over the stop 103.

In FIG. 1C, a mounting angle or top hook 106 is located near the outer edge of the front wind plate 107*b*, and is used to hold the wind plate on the container. Similarly, front wind plate 107*a* is held on the container by a mounting angle. See FIG. 7B for a better view of this feature.

In FIG. 1D, a locking bar is used to stiffen the two front plates 107*a,b*. Two mounting brackets 108*a,b* are rotatably connected to locking bars 109*a,b* and a locking bracket 110. The locking bars rotate with respect to the locking bracket. Other stiffening bars or locking rod designs could equally be utilized.

FIGS. 1E-1H show a front view, a right side view, a back view, and a top view respectively, of FIG. 1A.

FIG. 2A shows a single projecting (fairing) plate design that is a combination of two fairing plates 201*a,b* that are connected by a U bracket 203 and at least two locking pins 204 (FIG. 2E). Two back plates 202*a,b* are connected to the front fairing plates 201*a,b* respectively by three hinges 205 (detailed view FIG. 2F). Each back plate, attached hinges, and projecting fairing plate constitutes a separate foldable part of the two part design. Similarly to FIG. 1C, a hook 215 is located on the outer top edge of the back plate and holds it on the container.

FIG. 2E is a typical close up view of the U bracket 203, with a top locking pin 204. A lower locking pin is similar in design. In a preferred embodiment, more than two locking pins are used with the U bracket.

FIG. 2F is a typical close up of a locking bar 206 that is used to stiffen the design so that it is capable of withstanding air pressure, air turbulence, and train vibrations when moving. The locking bar is similarly designed to the locking bar as shown in FIG. 1D. As seen in FIGS. 2A-2D, there are a total of six locking bars in the design.

FIG. 2G is a top view of the single fairing design (FIG. 2A) when folded. As shown, the two halves of the embodiment are folded, and the locking bars provide for rotation around four pins to allow a compact storage. Similarly to FIG. 1B, FIG. 2I shows a rotating locking pin.

Figure 2H:
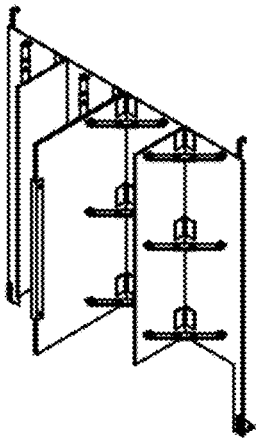
FIG. 2H is a modification to FIGS. 2A-2F where two additional fairing plates are added.

FIG. 2H is an alternate projecting fairing plate design comprising three projecting plates. It is similar in design to FIG. 2A, but two shorter fairing plates are added for reduced air drag.

The lower cutout on the base plates (i.e. reduced height) for the design in FIGS. 2A and 2H is helpful from a material handling and installation standpoint due to reduced weight and a lower stacking position on a well car.

The U bracket is also preferably designed to include a spring pin and predrilled holes on the front fairing plates for a rapid installation.

FIG. 3A is single front wind plate design. In this case, two front wind plate halves 301*a,b* are mildly angled 0-30 degrees (A2, FIG. 3B) from perpendicular to the train direction and are supported by projecting plates 306*a,b* respectively. Two base plates 302*a,b* are used to connect to the front of a container by methods already discussed (i.e. an upper hook 308 and lower insert 307 as seen in FIG. 3F). Each base plate is hinged (exemplary hinge 304 is labeled) to a front projecting plate, which in turn is hinged to a front wind plate.

Six locking bars, (exemplary locking bar 303 is labeled) are used to stiffen the two base plates to the projecting plates. The locking bars are similarly designed to the locking bar shown in FIG. 1D.

To provide stiffening, an upper plate clip 305*a* and a lower plate clip 305*b* (seen in the view of FIG. 3D) join the two hinged assemblies.

FIGS. 3B-3E show a top view, front view, right side view, and a back view respectively, of FIG. 3A. FIG. 3F is a detailed view of FIG. 3B.

Figure 4B:
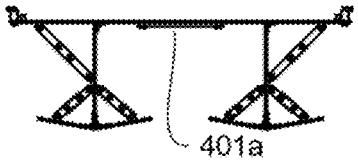
FIGS. 4A-4E show a dual front wind plate design in two connected parts.
Figure 4A:
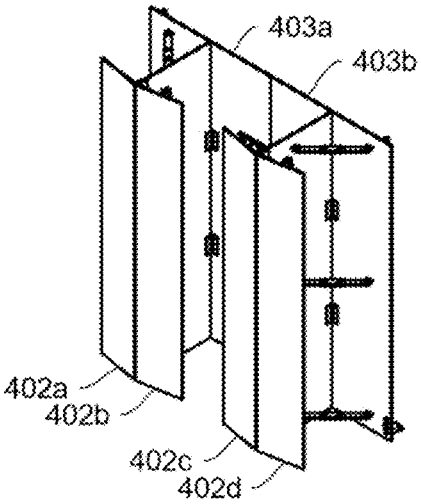

FIG. 4A shows dual front wind plate design very similar to FIG. 3A, the difference being the duplication of the front wind plate design of FIG. 3A. In this case, four front wind plate halves 402*a-d* are used to provide a greater reduction in air drag.

FIGS. 4B-4E show a top view, front view, right side view, and a back view respectively, of FIG. 4A.

Figure 4C:
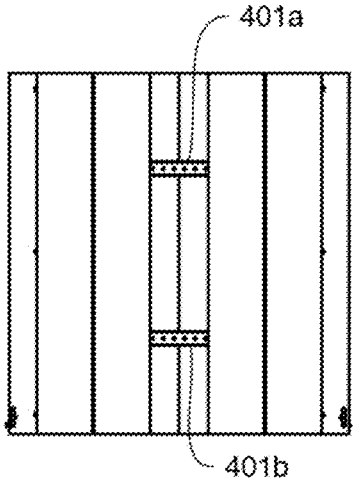
Figure 4D:
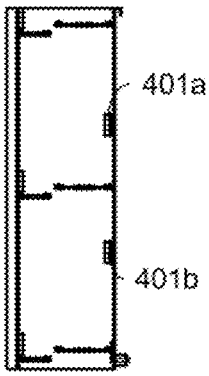
Figure 4E:
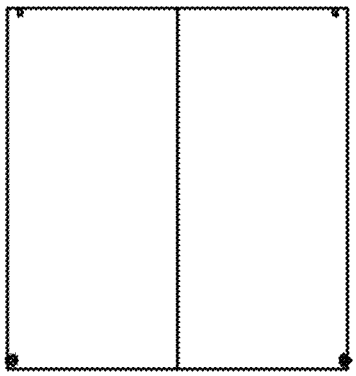

FIGS. 4B,4C show a U bracket 401*a,b* that is used to stiffen the two base plates 403*a,b*, and is oriented horizontally. The U bracket is shown in greater detail in FIG. 6F. A U bracket design is preferred over a flat plate in this case. A structural channel, such as a C channel could equally be used.

Figure 5A:
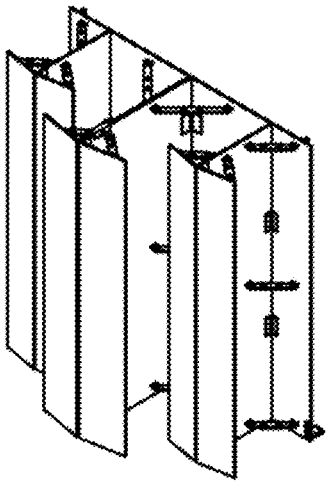
FIGS. 5A-5E show a triple front wind plate design in two connected parts.
Figure 5B:
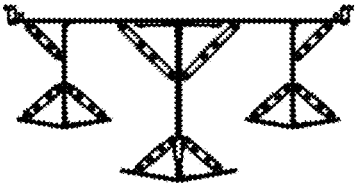
Figure 5C:
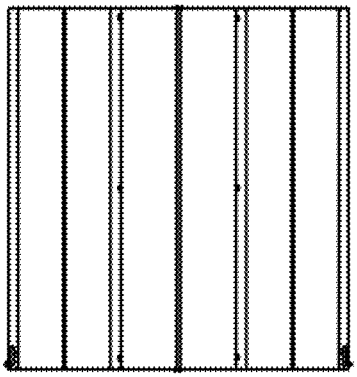
Figure 5D:
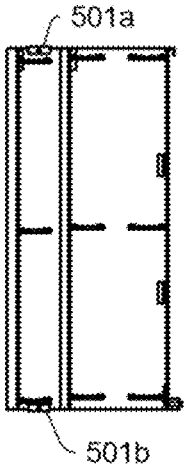
Figure 5E:
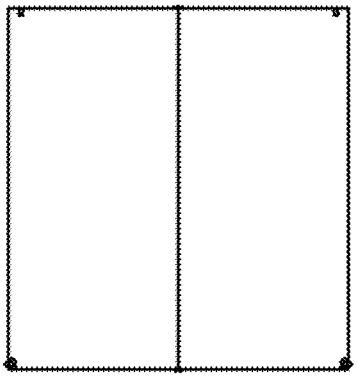

FIG. 5A shows triple front wind plate design similar to FIGS. 3A and 4A. In this case an upper and lower clip 501*a,b* are used to combine the two base plates similar to FIG. 3A.

FIGS. 5B-5E show a top view, front view, right side view, and a back view respectively, of FIG. 5A.

Figure 6A:
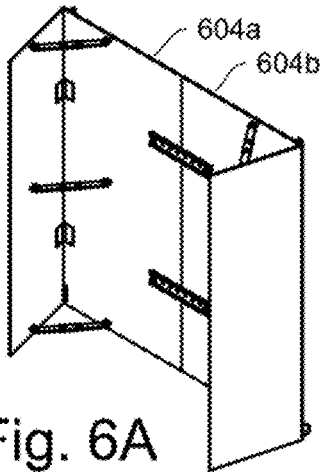
FIGS. 6A-6F show a dual angled fairing plate design in two connected parts.
Figure 6F:
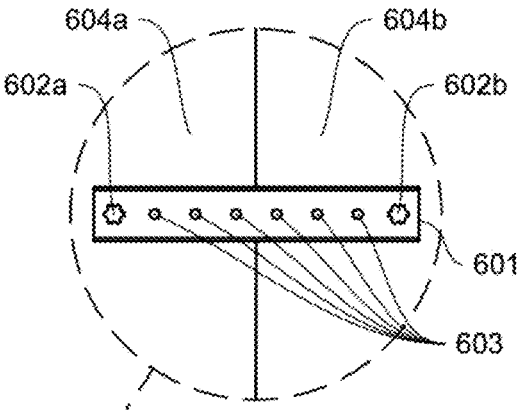
Figure 6B:
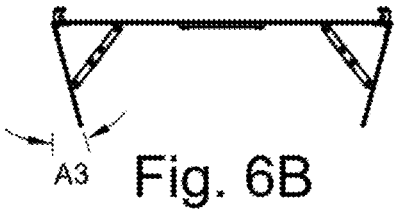
Figure 6C:
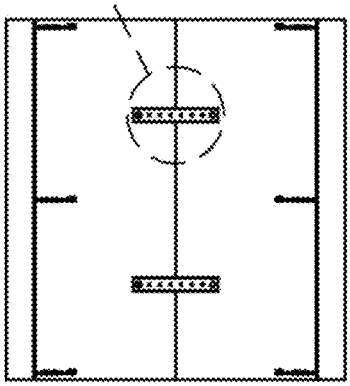
Figure 6D:
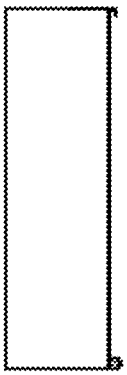
Figure 6E:
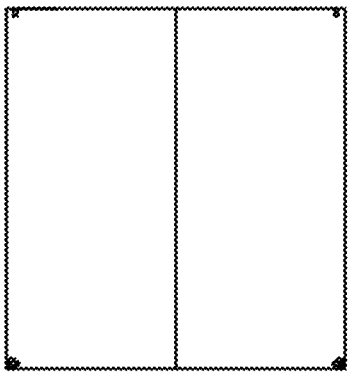

For adding a drag reducing design on the rear of the container, FIG. 6A shows a dual angled fairing plate design, with each fairing plate hinged to a separate base plate 604*a,b*. The base plates are connected together and stiffened by a pair of U bracket assemblies as shown in FIG. 6F. The U bracket 601 is placed over pins 603 which are mounted on the two base plates 604*a,b*. Two threaded handles 602*a,b* tighten down the bracket against two threaded shafts that are mounted on the two base plates 604*a,b*. This U bracket design provides base plate stiffening and convenient connection for an operator installing the design on a shipping container.

FIGS. 6B-6E show a top view, front view, right side view, and a back view respectively, of FIG. 6A. The angle A3 is preferably between 10 to 30 degrees. This embodiment similarly uses locking bar assemblies as described and shown in FIG. 1D. Additionally, the design utilizes attaching hooks and rotating locking pins as previously described in other embodiments.

Figure 7A:
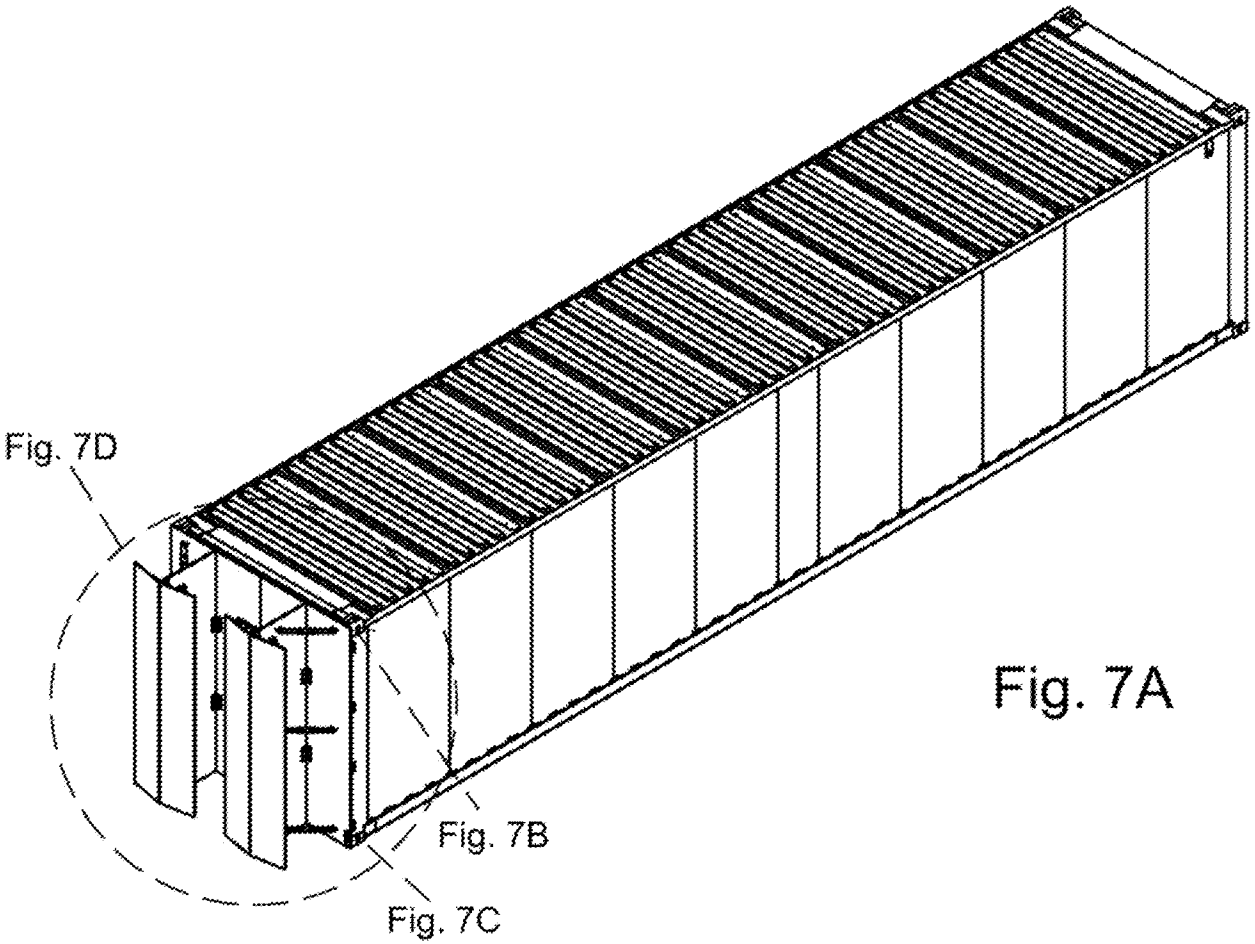
FIGS. 7A-7E show a typical shipping container with an exemplary foldable aerodynamic drag reducing plate assembly and how it attaches.

FIG. 7A shows the dual front wind plate design connected to a shipping container. Although the dual front wind plate design is shown, any of the embodied designs can be similarly attached.

Figure 7B:
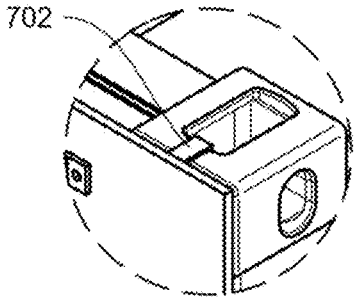
Figure 7C:
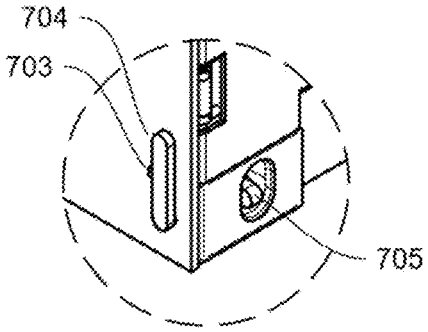
Figure 7D:
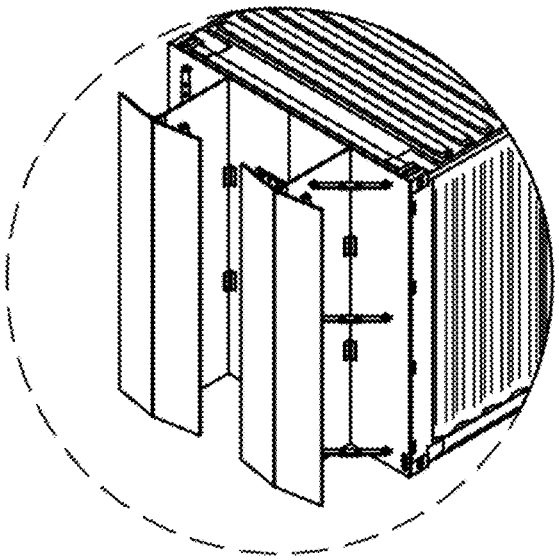

FIG. 7D shows a larger view of the front end of a shipping container. FIG. 7B shows the typical attaching hook 702 as mounted in a top container opening. FIG. 7C shows the typical insert assembly (as also seen in FIG. 1B) with a locking pin 705, a handle 704, and a stop 703.

Figure 7E:
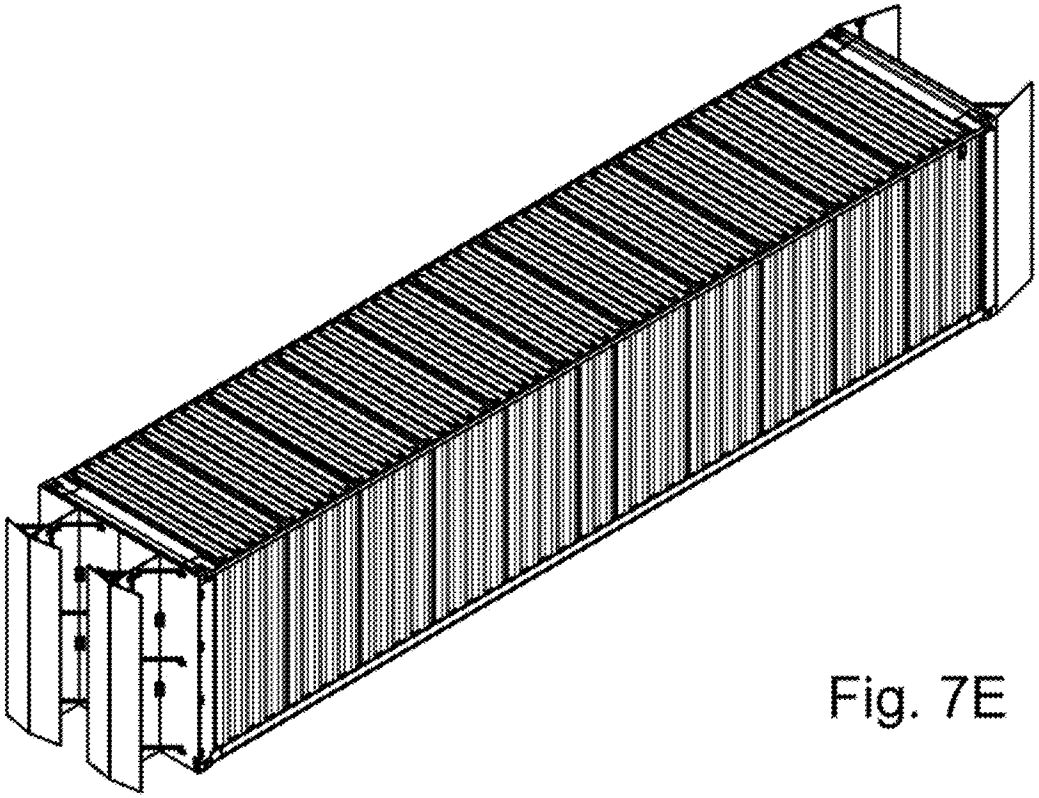

FIG. 7E shows a typical shipping container with a front drag reducing plate from FIG. 4A, and a back drag reducing plate from FIG. 6A.

Figure 8A:
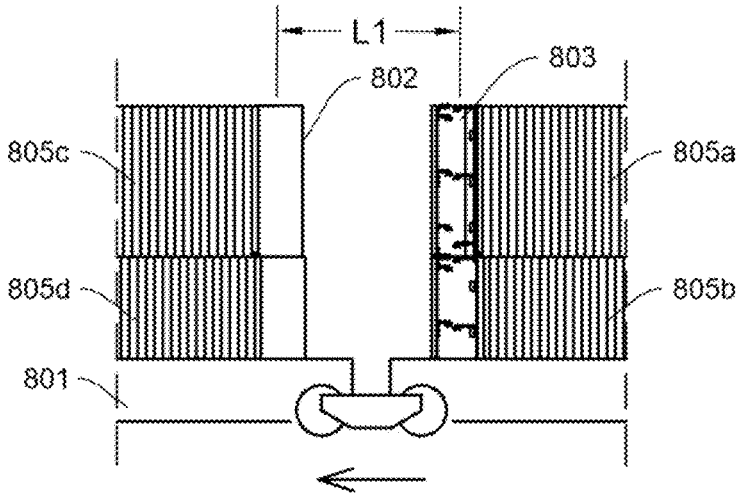
FIGS. 8A-8B show typical spacing between railroad shipping containers.

FIG. 8A shows a typical stacking of shipping containers when on a railroad well car 801. In this case, two well cars share a pair of railroad wheels. The four containers 805*a-d* incorporate a drag reducing end design 802 (see FIG. 6A) on the left and a drag reducing front design 803 (see FIG. 4A) on the right while the train moves from right to left. The distance L1 is eleven feet, which is spaced far enough so that there is reduced platooning advantage from the left car. Therefore, a drag reducing design is needed for the two downwind containers 805*a,b*, and also the upwind containers 805*c,d*.

Figure 8B:
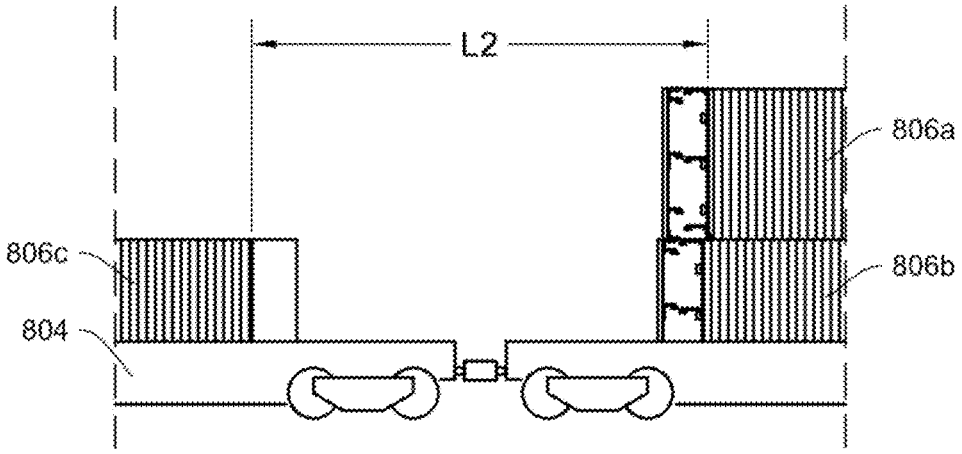

Similarly, FIG. 8B shows another typical stacking of shipping containers 806*a-c* on a railroad well car 804. In this case, each well car has its own pair of wheels on either side of a coupler. The distance L2 is twenty-two feet, and there is no significant platooning advantage from the previous car. Note that the well car on the left only has one shipping container. Though two containers are preferred, a single container car is often the result of scheduling, available railroads, urgent delivery needs, and the like.

The single fairing plate design as shown in FIG. 2A, or multiple fairing plates shown in FIG. 2H, are especially useful when reducing the air drag for a container located on the bottom of a well car 805*b*, 806*b*. The lower cutout on the base plates is helpful from a material handling and installation standpoint due to reduced weight and lower stacking position in the well car.

Figure 9A:
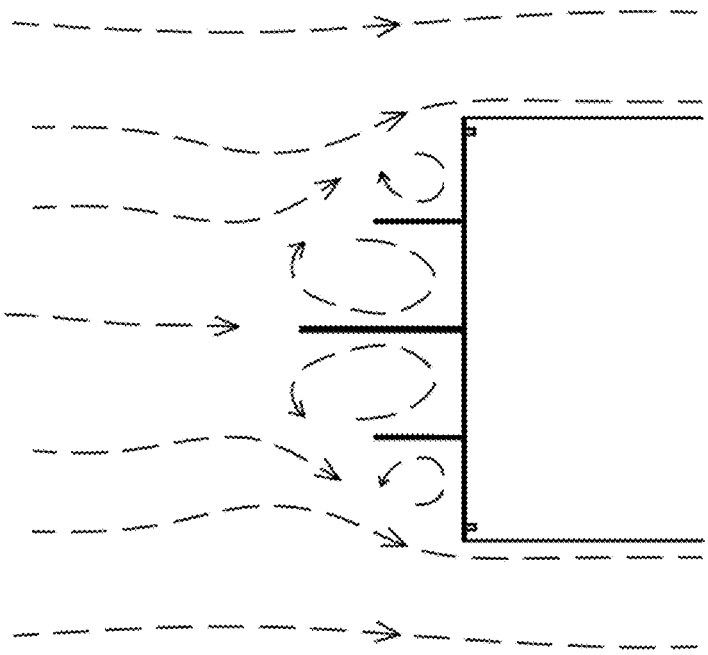
FIG. 9A-9B are a top view of expected air flow patterns around selected embodiments.
Figure 9B:
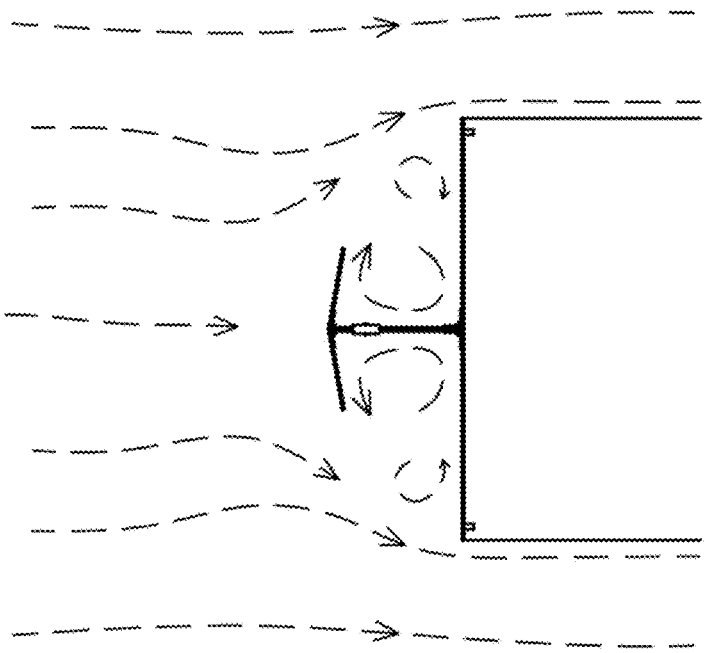

FIGS. 9A-9B show a top view of expected air flow movement in dashed lines around a front wind plate design according to the designs exemplified by FIG. 2H and FIG. 3A.

It is generally conceived that the plates used in the foldable aerodynamic drag reducing plate assembly will be made from a lightweight material, such as an engineered plastic or a thin metal plate. Durability in frequent and long term use, and the ability to withstand moderate mishandling and storage are important design criteria.

While various embodiments of the present invention have been described, the invention may be modified and adapted to various operational methods to those skilled in the art. Therefore, this invention is not limited to the description and figures shown herein, and includes all such embodiments, changes, and modifications that are encompassed by the scope of the claims.

I claim:

1. A foldable aerodynamic drag reducing plate assembly for a front of an intermodal container comprising:

A) two half assemblies, each said half assembly further comprising:

a) a rectangular shaped base plate, b) an extending plate attached to a lower edge of said base plate, c) at least one rectangular shaped projecting plate, d) said at least one projecting plate is perpendicular to said base plate, e) said at least one projecting plate is connected to said base plate by a plurality of hinges and by a plurality of locking bar assemblies, f) a hook positioned substantially at a top edge of said base plate, g) said hook fits inside an upper intermodal opening, h) a rotating locking pin positioned substantially at a lower edge of said extending plate, and i) said rotating locking pin fits inside a lower intermodal opening, and B) at least one bracket connecting both said half assemblies.

2. A foldable aerodynamic drag reducing plate assembly according to claim 1, each said locking bar assembly further comprising:

A) two mounting brackets,

B) two locking bars, and

C) a locking bracket connecting said locking bars.

3. The foldable aerodynamic drag reducing plate assembly according to claim 1, wherein each said half assembly further comprises:

A) a rectangular shaped wind plate oriented between 0 and 30 degrees from perpendicular to said projecting plate, and B) a plurality of said hinges and said locking bar assemblies connecting said wind plate to said projecting plate.

* * * * *